United States Patent [19]

Becker et al.

[11] Patent Number: 4,979,424

[45] Date of Patent: Dec. 25, 1990

[54] DEVICE FOR SETTING A FUSE

[75] Inventors: Wilfried Becker; Detlef Behrens, both of Dusseldorf; Stefan Thiesen, Erkrath; Josef Metz, Neuss, all of Fed. Rep. of Germany

[73] Assignee: Rheinmetall GmbH, Düsseldorf, Fed. Rep. of Germany

[21] Appl. No.: 429,816

[22] Filed: Oct. 19, 1989

[30] Foreign Application Priority Data

Oct. 21, 1988 [DE] Fed. Rep. of Germany ..... 3835889

[51] Int. Cl.[5] ..... F42C 11/06; F42C 17/00

[52] U.S. Cl. ..... 89/6.5

[58] Field of Search ..... 89/6.5; 102/214

[56] References Cited

U.S. PATENT DOCUMENTS

| | | | |
|---|---|---|---|
| 2,415,362 | 2/1947 | Midgley | 89/6.5 |
| 3,814,017 | 6/1974 | Backstein et al. | 89/6.5 |
| 4,064,806 | 12/1977 | Apstein et al. | 102/210 |
| 4,091,734 | 5/1978 | Redmond et al. | 89/6.5 |
| 4,114,815 | 3/1979 | Cumming et al. | 102/2.4 |
| 4,664,013 | 5/1987 | Wagner et al. | 89/6.5 |
| 4,852,457 | 8/1989 | Schlegel et al. | 89/6.5 |

FOREIGN PATENT DOCUMENTS

| | | |
|---|---|---|
| 0265815 | 5/1988 | European Pat. Off. . |
| 3307785 | 9/1984 | Fed. Rep. of Germany . |

*Primary Examiner*—David H. Brown

*Attorney, Agent, or Firm*—Spencer & Frank

[57] ABSTRACT

An arrangement for wirelessly setting, i.e. timing, ammunition provided with a programmable fuse and disposed in a gun barrel, which arrangement does not require complicated structural measures in and at the gun barrel and is not subject to the pressure and temperature influences generated by the propelling charge gases. The arrangement includes a simple and protected data transmitting unit fastened adjacent the beach of the weapon on, e.g., the interior wall or ceiling of a turret of an armored vehicle, a holding arm fixed to the weapon cradle or directly to the rear breech housing for the weapon, a special receiving antenna on the rear cartridge base or cartridge collar of the loaded ammunition, and a free optical data transmission path between the transmitter and the antenna.

17 Claims, 4 Drawing Sheets

DEVICE FOR SETTING A FUSE

BACKGROUND OF THE INVENTION

The present invention relates to an arrangement for timing, i.e. setting, programmable fuses in cartridges which are already loaded in the gun barrel of a weapon and to ammunition for use with the timing arrangement.

Devices or arrangements for setting the timing of cartridges having programmable fuses and disposed in a gun barrel are known. In the case of transmission by wire, a setting signal is customarily fed by wire from the fire control (tank gunner) to the fuse disposed in the cartridge (multi-purpose propelling charge fuse MTA) to a direct electrical central contact in the base of the cartridge via a fixed contact disposed at an appropriate location in the breech of the weapon. The drawback here is that powder vapor deposits or the like may lead to difficulties in making contact.

In the case of wireless transmission, the fuse is set by means of optical or electronic transmit/receive devices In this connection, U.S. Pat. No. 4,144,815, for example, discloses an arrangement for transmitting a setting pulse by means of a microwave field in the gun barrel. In this arrangement, the fuse disposed in the tip of the projectile is provided with an appropriate antenna and a microwave transmitter connected with an input device is provided in the muzzle region of the gun barrel.

Here again, during rapid sequence fire, powder vapors or great fluctuations in temperature may cause interference with transmission. Moreover, the transmitting unit opening into the gun barrel must be very robust and pressure resistant; it requires an expensive type of microwave cable lead and coupling members at the gun barrel and must of course be disassembled or exchanged any time a gun barrel is exchanged.

Federal Republic of Germany No. DE-OS 3,307,785, corresponding to U.S. Pat. No. 4,664,013 also discloses a method and an apparatus for setting a projectile fuse in which data carrier pulses are transmitted in a wireless mode by means of high frequency (induction current) or by means of light pulses over an optical transmission path. For this purpose, a transmission unit (coil or optical conductor) is integrated into the projectile body when it is disposed in the gun barrel and the projectile itself is provided with an annular circumferential (electrical or optical) receiving system in its center region. The transmitting unit in the barrel is here likewise subjected to high pressures and high temperatures and to uncontrollable soiling due to erosion, deposits, etc.

SUMMARY OF THE INVENTION

It is an object of the present invention to provide a data transmission system for setting the fuse of ammunition when it is already in the gun barrel so that the transmission system it is not subjected to any extreme stresses and is easily monitored.

The above object is basically achieved according to the present invention by an arrangement for setting a programmable timed fuse in a cartridge which is loaded in the gun barrel of a weapon, which arrangement includes a data input device and a fuse setting device which is in operative connection with the input device and which is disposed in the interior of the cartridge; and wherein: the weapon, in its breech region, has at least one radially extending recess which permits direct optical visibility of the rear base portion of the cartridge casing of a loaded cartridge when the breech of the weapon is closed; and the input device includes signal receiving means which are disposed on the circumferential surface of the rear base portion of the cartridge casing so as to be optically visible via the at least one recess when the cartridge is in a loaded position and which are in operative connection with the fuse setting device, and a data transmitting means, disposed in the close vicinity of the breech housing of the weapon, for wirelessly transmitting setting signals for the fuse setting device to the signal receiving means via the recess.

According to additional features of the invention, the weapon has a wedge type breech block and the at one radially extending recess is disposed between the wedge type breech block and the rear end of the gun barrel; the signal receiving means is an electromagnetic wave radiation detector, e.g. an RF antenna or a light (preferably infrared) detector; and the weapon is mounted in the turret of an armored vehicle, with the transmitting means being disposed within the turret and preferably mounted so as to directly radiate energy to the signal receiving means via the radial recess.

Due to the fact that the input device is composed of a transmitting unit for fuse programming pulses disposed in the region of the breech of the gun, and preferably in the protected interior of the turret, this transmitting unit can easily be monitored, and exchanged if necessary. Moreover, it is not subjected to any extreme temperature and pressure stresses as are the prior art transmitting devices.

The establishment according to the invention of an electromagnetic wave, e.g., optical or radio frequency, data transmission path between the (armored) fire control system and the cartridge disposed in the chamber of the weapon does not pose any safety problems since it contains its own programming circuit. Due to its low susceptibility to interference or possibilities for interference, this transmission path offers high data transmission reliability and can be retrofitted at little cost for modifications to any weapons system in existing large-caliber weapons.

Modern types of high-explosive ammunition for armored cannons are required to have the fastest possible reaction time between setting of the associated fuse and the actual shot being fired. This requirement can be met, of necessity, only by way of setting/programming the fuse in a cartridge that is already disposed in the cartridge chamber of the weapon. This can very advantageously be realized with the fuse setting device according to the present invention.

Deactivation of an already set fuse and unloading deactivated ammunition from the gun barrel is ensured in the simplest and safe manner.

The data transmission system according to the invention is based on the simple utilization of a free location between the wedge-type breechblock and the rear portion of the gun barrel. Such a location, or a corresponding "window", is already available in the Leopard II combat tank, and other armored weapons can easily be provided with such a "window," within the protected turret region where direct access to the cartridge is possible when the wedge-type breechblock of the weapon is closed. In the breech ring (breech bolt housing) of the weapon, part of the edge of the metal cartridge casing collar, which casing may either be a full length casing or a cartridge base (stub-type casing) of a cartridge having a partially combustible propellant casing, is freely visible from the top and bottom even if the wedge-type breechblock is closed. This free location and the freely accessible line of sight is utilized in the present invention as the data transmission path for setting the fuse. The data receiving member, i.e. the radiation detector, e.g., an RF antenna, is advantageously not seated directly in the chamber that is charged with gas pressure and powder vapors or in the front portion of the gun barrel, but rather at the rear end or collar of the projectile casing which is configured, for example, as a metal stub casing and is provided with a rubber sealing ring at its forward, combustible section of the cartridge casing. The metal portion of the casing (obturator) together with the sealing ring protect the receiving unit from gas pressure and powder vapors.

In contrast to prior art comparable transmission devices, this results in a safety advantage for the ammunition, in greater data transmission reliability, and in less additional expenditures for the weapons systems. In the case of a possibly required exchange of barrels, the data transmission system according to the invention is not affected.

The invention will be described and explained below in greater detail with reference to a number of embodiments that are illustrated only schematically in the drawing figures.

DETAILED DESCRIPTION OF THE PREFERRED EMBODIMENTS

Figure 1:
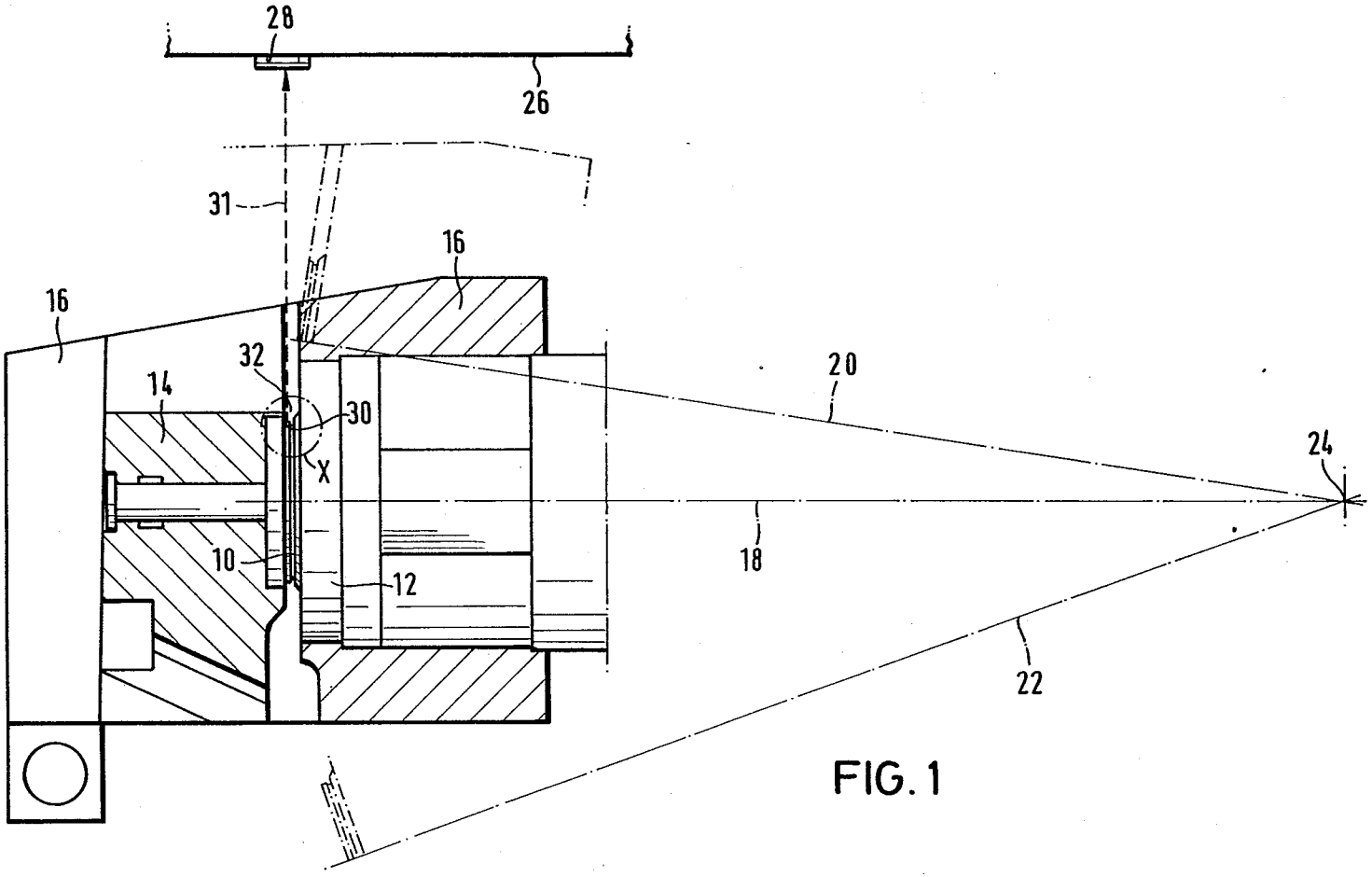
FIG. 1 is a schematic side view of a first embodiment of the fuse setting/data transmission arrangement according to the invention disposed in the rear section of a turret protected weapon system which is shown only in part.

In FIG. 1 the reference numeral 10 identifies the base of a cartridge which, in a conventional manner, is provided with an adjustable time fuse (not shown in this Figure), e.g., high-explosive ammunition provided with an integrated programmable time fuse. As shown, the cartridge is disposed in the chamber of an armored weapon having a caliber of, for example, 120 mm. A wedge-type breechblock 14 in the breech housing 16 fixes the cartridge in the chamber of the gun barrel 12.

The reference numeral 18 identifies the bore axis of gun barrel 12 in its horizontal, normal or loading position. The elevational adjustment range in the vertical direction of gun barrel 12 about a cradle axis 24 is indicated, and shown in dashed lines, by the upper position 20 of the bore axis, where the gun barrel 12 is lowered in front, and the lower position 22 of the bore axis where the gun barrel 12 is in a steeply elevated orientation. Above breech housing 16, a section of the turret ceiling 26 of an armored vehicle, e.g. a Leopard II combat tank, is visible. Between turret ceiling 26 and weapon breech 14, 16, a wireless data transmission path 31 is provided at the rear section of gun barrel 12 so as to radiate energy and information regarding the timing and setting of a programmable time fuse when the cartridge is in its loaded position. For this purpose, a data transmitting unit 28 is disposed on the inner surface of the turret ceiling 26 so that, in the illustrated loading position, the unit 28 is opposite and in an optical line of sight with a data receiving radiation detector 30, e.g. an RF antenna, disposed on the circumferential surface of the cartridge casing base 10 or in the radial cartridge casing collar, i.e., adjacent the rear end of the cartridge casing. As indicated above, the cartridge casing may be a conventional metal casing or the metal stub casing of a partially combustible cartridge casing as employed in armor-piercing ammunition.

Due to its structural configuration, the Leopard II combat tank is already provided with a radial gap or recess 32 ("window") at the top and at the bottom the between the breech housing 16 and the wedge-type breech block 14. In other weapon carriers, such a radial recess can easily be provided at a later time and at a suitable location, e.g. in the breech housing. The radial recesses 32 provide a direct optical line of sight of the rear cartridge base 10 and data receiving antenna 30, and thus a free data transmission path 31 toward the top and a free data transmission path 31 toward the bottom between the antenna 30 and the transmitting unit 28 for the wireless propagation of energy and setting signals.

The wireless energy and data transmission may be effected by any suitable electromagnetic type waves, for example, by infrared waves, optically visible light pulses or microwaves or other RF frequency waves as the pulse carriers.

While the transmit and receive units, including the radiation detectors, are known per se, the arrangement and location of such components according to the present invention to provide the described advantages, are not known.

Figure 2:
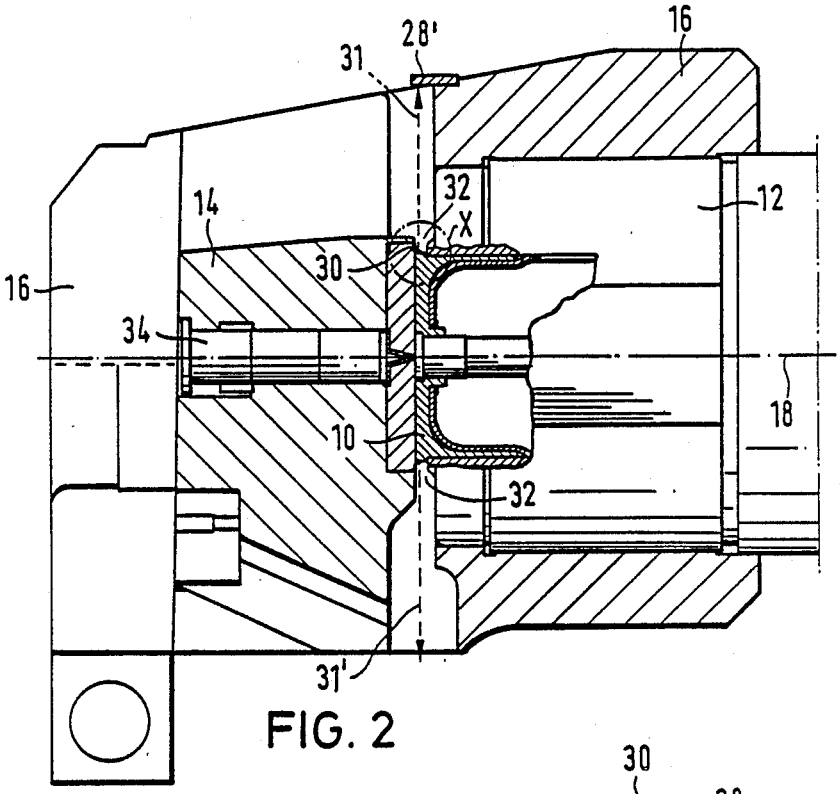
FIGS. 2 and 2A are likewise schematic side views, in a somewhat enlarged illustration, showing modifications of the arrangement of FIG. 1 of the location of the data transmission device.

FIG. 2 shows the rear region of the weapon to a somewhat enlarged scale. A firing contact o firing pin 34 for firing the ammunition is indicated in the wedge-type breechblock 14. According to the embodiment of the invention shown in FIG. 2, the data transmitting unit 28' is fixed to the upper portion of the breech housing 16 at the outer end of the upper radial recess 32 opposite the antenna 30 so that the data transmission path 31 extends between the transmitting unit 28' and the antenna 30. Thus the transmission path 31 becomes shorter, than in the embodiment of FIG. 1. However, it now is necessary to provide a flexible electrical lead (not shown) for the transmitting unit 28'.

Figure 2A:
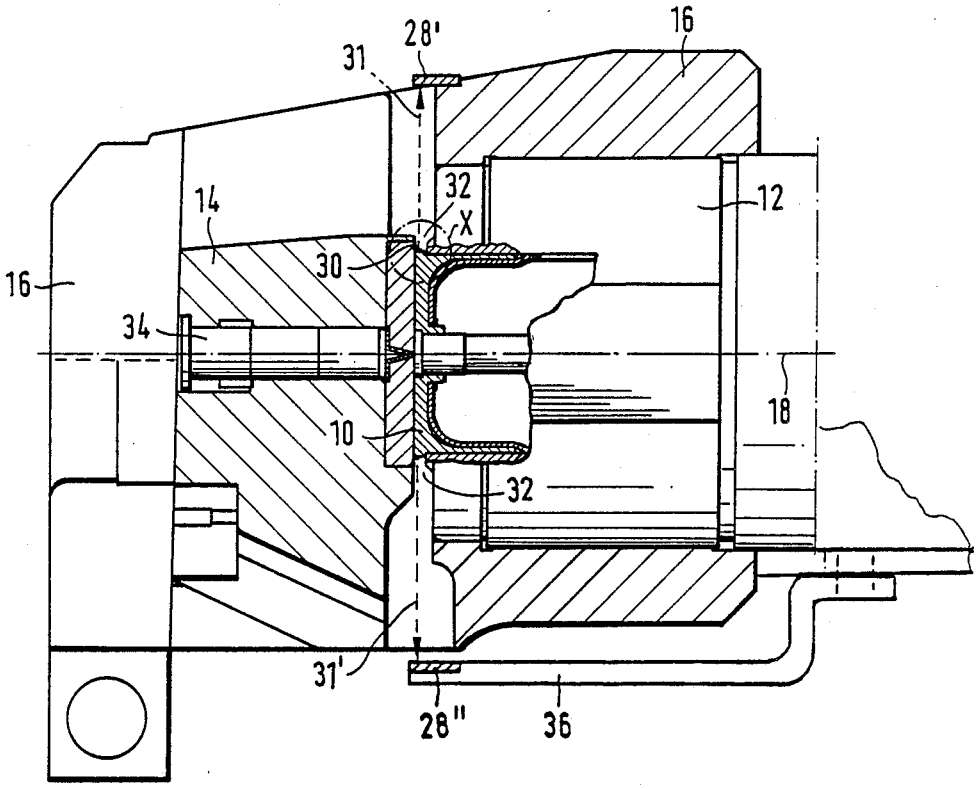

FIG. 2A shows the further possibility according to the present invention of mounting the transmitting unit 28'' so that it is opposite the lower recess 32 between the wedge-type breechblock 14 and breech housing 16 and in optical data path 31' via a holding arm 36 which, in a manner not illustrated, is fastened directly to the cradle of the weapon. The transmitting unit 28'' in its location fixed to the cradle participates in only the elevational movements of the weapon, but not in recoil and counter recoil movement of the gun barrel.

Figure 3:
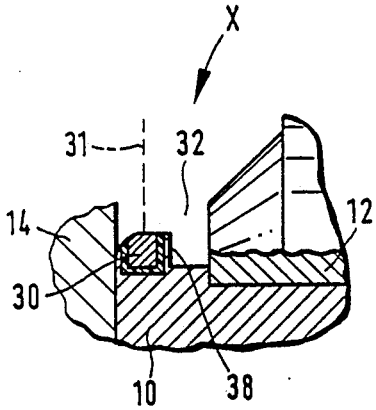
FIG. 3 is an enlarged sectional view of the encircled region X of FIG. 1 or FIG. 2 showing the rear portion of a cartridge according to the invention provided with a settable time fuse.

FIG. 3 shows a detail X of FIG. 1 or FIG. 2 in an enlarged view. Between the wedge-type breechblock 14 and the rear end of gun barrel 12 or, more precisely, breech housing 16, a recess 32, i.e. a "window" or space, remains at the top and bottom in which the rear region of the cartridge base 10 becomes optically visible. The radiation detector or receiving antenna 30 is disposed in a recess formed in the circumferential surface of the base edge or cartridge collar 38 and isolated from same by a layer of electrical insulation 40, and is in electrical communication with the programmable fuse disposed in the projectile (not shown) in this figure.

Figure 4:
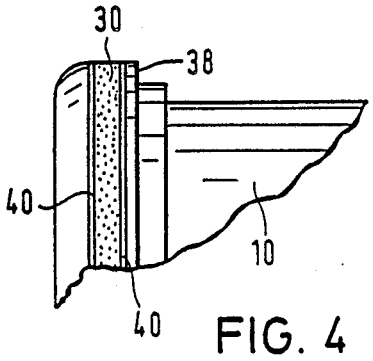
FIG. 4 is a partial sectional side view of the cartridge base of an adjustable time fuse cartridge showing a preferred embodiment of the data receiving detector or antenna according to the invention.
Figure 5:
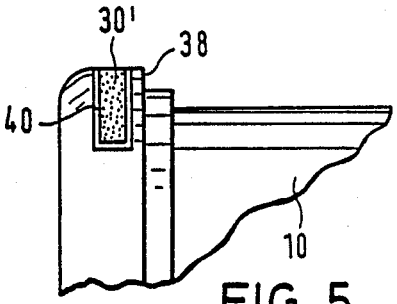
FIGS. 5 and 5A are partial sectional view of the cartridge base similar to that of FIG. 4 showing further possible embodiments of the data receiving detector or antenna according to the invention.
Figure 5A:
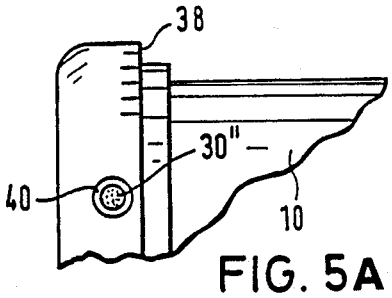

FIG. 4 shows the receiving antenna 30, including its insulation 40, according to one embodiment of the invention, in cartridge collar 38 in the form of an annular circumferential antenna. Alternatively, as shown in FIGS. 5 and 5A, the receiving antenna according to the invention disposed in cartridge collar 38 may be a dot-shaped antenna 30" (FIG. 5A) or a strip-shaped antenna 30' extending over only a limited portion of the circumference of collar 38 (FIG. 5). In the case of the antenna configurations of FIGS. 5 and 5A, it is then necessary for the corresponding cartridge to reach the weapon in a defined loading portion so that the antenna 30' or 30" appears at an index position, in order to always ensure that the receiving antenna 30' or 30" is disposed opposite a transmitting unit 28, 28' or 28" and that a data transmission path 31, 31' has been established.

Figure 6:
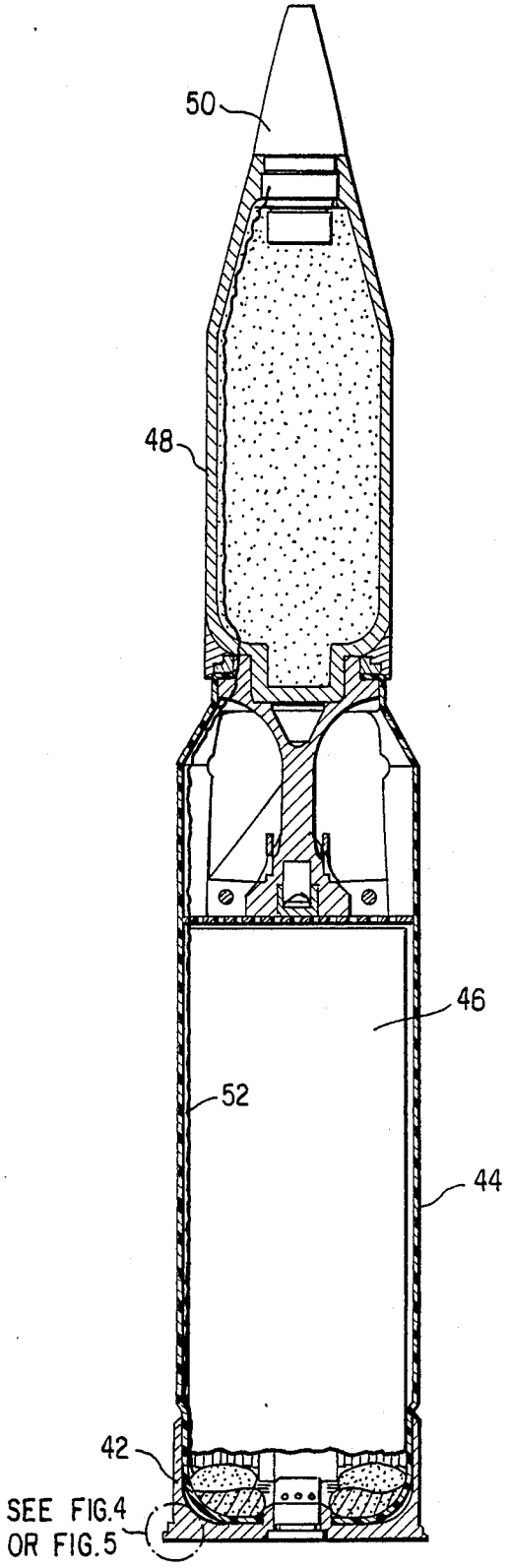
FIG. 6 shows a HE-round with a combustible shell. The projectile shown here has its fuse at the nose. The connection between the detector on the stub-case and the fuse may be a wire or cable.

FIG. 6 shows the entire cartridge of a HE-round (high explosive). It is containing a stub-case 42 with an antenna or detector as shown in FIG. 4, 5, or 5A a combustible shell 44 with the propellant charge 46, a HE-filled projectile 48 with a nose mounted programmable fuse 50 with an incorporated fuse setting device. The internal connection between the detector or antenna on the stub-case 42 and the programmable front fuse 50 here shown is a wire 52.

The invention now being fully described, it will be apparent to one of ordinary skill in the art that changes and modifications can be made thereto without departing from the spirit or scope of the invention as set forth herein.

What is claimed:

1. In an arrangement for setting a programmable timed fuse in a cartridge which is loaded in the gun barrel of a weapon, said arrangement including a data input device and a fuse setting device which is in operative connection with said input device and which is disposed in the interior of the cartridge; the improvement wherein: said weapon, in its breech region, has at least one radially extending recess which permits direct optical visibility of the rear base portion of the cartridge casing of a loaded cartridge when the breech of the weapon is closed; and said input device includes signal receiving means which are disposed on the circumferential surface of said rear base portion of said cartridge casing so as to be optically visible via said at least one recess when said cartridge is in a loaded position and which are in operative connection with the fuse setting device, and a data transmitting means, disposed in the close vicinity of the breech housing of said weapon, for wirelessly transmitting setting signals for said fuse setting device to said signal receiving means via said at least one recess.

2. An arrangement as defined in claim 1 wherein said weapon has a wedge-type breech block and said at least one radially extending recess is disposed between said wedge-type breech block and the rear end of said gun barrel.

3. An arrangement as defined in claim 1 wherein said signal receiving means is a radiation detector.

4. An arrangement as defined in claim 3 wherein said radiation detector is an antenna.

5. An arrangement as defined in claim 1 wherein: said weapon is mounted in the turret of an armored vehicle; and said transmitting means is disposed within said turret.

6. An arrangement as defined in claim 5 wherein said signal transmitting means is mounted so as to directly radiate energy to said signal receiving means via said at least one recess.

7. An arrangement as defined in claim 6 wherein said transmitting means is fastened to the inner surface of one of the ceiling and a side wall of said turret at a position to be aligned with said recess and approximately at a right angle to the bore axis of said gun barrel when said gun barrel is in its zero elevation position, i.e. in its loading position.

8. An arrangement as defined in claim 6 wherein said transmitting means is fastened to said breech housing of said weapon at the outer end of said recess.

9. An arrangement as claimed in claim 6 wherein said transmitting means is mounted opposite said recess via a holding arm fastened to the cradle of said weapon.

10. In an ammunition to be fired from a gun including a projectile attached to a propellant casing with said projectile including a programmable timed fuse and with said ammunition including signal receiving means for receiving a signal for setting said fuse; the improvement wherein said signal receiving means includes an electromagnetic radiation detector disposed in the circumferential surface of said propellant casing adjacent its rear end.

11. Ammunition as defined in claim 10 wherein said radiation detector is an antenna for receiving radio frequency waves.

12. Ammunition as defined in claim 10 wherein said radiation detector is a light detector.

13. Ammunition as defined in claim 10 wherein: said propellant casing has a radial collar at its said rear end and said radiation detector is disposed on the circumferential surface of said collar.

14. Ammunition as defined in claim 10 wherein said radiation detector is dot shaped.

15. Ammunition as defined in claim 10 wherein said radiation detector is strip shaped with a limited extend in the circumferential direction.

16. Ammunition as defined in claim 10 wherein said radiation detector is annular.

17. Ammunition as defined in claim 14 wherein said radiation detector is a radio-frequency antenna.

* * * * *